US005176121A

United States Patent [19]

Kennedy

[11] Patent Number: 5,176,121

[45] Date of Patent: Jan. 5, 1993

[54] BUMPERS FOR PROTECTING AN O-RING SEAL OF A FUEL INJECTOR DURING THE INJECTOR'S INSERTION INTO A SOCKET

[75] Inventor: Gary I. Kennedy, Chatham, Canada

[73] Assignee: Siemens Automotive Limited, Chatham, Canada

[21] Appl. No.: 863,637

[22] Filed: Apr. 6, 1992

[51] Int. Cl.[5] ..... F02M 55/02

[52] U.S. Cl. ..... 123/470; 123/456

[58] Field of Search ..... 123/470, 469, 468, 472, 123/456; 239/600, 550

[56] References Cited

U.S. PATENT DOCUMENTS

| | | | |
|---|---|---|---|
| 4,860,710 | 8/1989 | Hafner | 123/470 |
| 4,934,329 | 6/1990 | Lear | 123/456 |
| 4,966,120 | 10/1990 | Itoh | 123/470 |
| 5,016,594 | 5/1991 | Hafner | 123/456 |
| 5,046,469 | 9/1991 | Gmelin | 123/470 |
| 5,058,554 | 10/1991 | Takeda | 123/470 |
| 5,095,876 | 3/1992 | Yonekawa | 123/468 |
| 5,121,931 | 6/1992 | Jones | 123/468 |
| 5,140,963 | 8/1992 | Brackett | 123/470 |

FOREIGN PATENT DOCUMENTS

| | | | |
|---|---|---|---|
| 0042532 | 4/1979 | Japan | 123/468 |
| 0188670 | 7/1990 | Japan | 123/470 |

*Primary Examiner*—Carl S. Miller

*Attorney, Agent, or Firm*—George L. Boller; Russel C. Wells

[57] ABSTRACT

The interior sidewall surface of a fuel injector socket is provided with a pair of bumpers, one to either side of an opening in the sidewall surface that communicates the socket to a fuel passage. The bumpers prevent an O-ring seal that is disposed around the outside of the fuel injector from contacting the edge of that opening during insertion and removal of the fuel injector into and from the socket. The bumpers have radiused surfaces that are presented to the fuel injector so that their contact with the O-ring does not damage the O-ring.

16 Claims, 1 Drawing Sheet

BUMPERS FOR PROTECTING AN O-RING SEAL OF A FUEL INJECTOR DURING THE INJECTOR'S INSERTION INTO A SOCKET

FIELD OF THE INVENTION

This invention relates generally to electromechanical fuel injectors that are commonly used in the fuel systems of internal combustion engines. More specifically, it relates to an improvement for protecting an 0-ring seal on the fuel injector during insertion of such a fuel injector into a mounting socket.

BACKGROUND AND SUMMARY OF THE INVENTION

One typical fuel rail assembly for an internal combustion engine comprises a fuel rail member having a longitudinally extending main fuel passage and several sockets that transversely intersect the main fuel passage at selected locations along its length. An electromechanical fuel injector is disposed in each socket in a sealed manner such that pressurized liquid fuel in the main fuel passage is delivered to the fuel injector without leaking from the fuel rail assembly. When the fuel rail assembly is operatively associated with an engine, the nozzle of each fuel injector is disposed to inject fuel into a corresponding combustion chamber space of the engine in accordance with the selective electrical operation of the fuel injector's solenoid.

The intersection of each socket with the main fuel rail passage creates an opening between them, and at the interior wall surface of the socket this opening is circumscribed by an endless edge. During insertion and removal of a fuel injector into and from a socket, an O-ring seal on the fuel injector passes across this opening. Depending upon the nature of the process for fabricating the fuel rail member, this edge may be sharp, and therefore pose the possibility of damaging the O-ring during the fuel injector's insertion and removal into and from the socket if the O-ring makes contact with the sharp edge. While the exercise of care during the fuel injector's insertion and removal into and from the socket may be sufficient to avoid O-ring damage,.the realities of mass-production assembly and periodic servicing cannot provide 100% assurance that damage will never occur. While it is possible to remove the sharp edge by performing additional secondary operations, e.g., milling, deburring, these measures require additional equipment and processing time, thereby adding to the cost of the fuel rail assembly.

The present invention relates to an innovative solution which is capable of providing improved protection of the O-ring seal during fuel injector installation and removal without incurring the expenses associated with the performance of secondary operations to remove the aforementioned sharp edge. Briefly, the invention comprises the inclusion of two bumpers on the interior wall of the socket, one to either side of the opening between the socket and the main fuel passage, circumferentially about the socket. These bumpers are axially co-extensive with the opening and prevent the O-ring from contacting the edge of the opening. They present smooth rounded surfaces to the fuel injector so that in the event that the O-ring comes into contact with the bumpers during the insertion or removal process, it will pass against a radiused surface that will not damage it. These bumpers can be advantageously incorporated into the fuel rail member by integrally molding them with the socket; in other words, by designing them into the mold that is used to mold the socket so that they are inherently created during the molding process. The illustrated bumpers can be molded without the necessity of undercuts that would require subsequent operations or make the mold more complicated.

Further features, advantages, and benefits of the invention, along with additional ones, will be seen in the ensuing description and claims which should be considered in conjunction with the accompanying drawings.

DESCRIPTION OF THE PREFERRED EMBODIMENT

Figure 2:
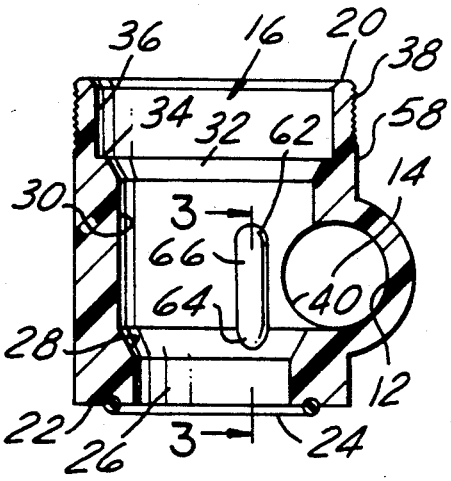
FIG. 2 is a longitudinal cross sectional view through the socket as taken in the direction of arrows 2—2 in FIG. 1.
Figure 3:
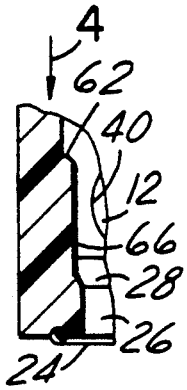
FIG. 3 is a fragmentary cross sectional view as taken in the direction of arrows 3—3 in FIG. 2.

FIGS. 1–5 disclose a fuel rail member 10 embodying principles of the invention. Fuel rail member 10 comprises a main fuel passage 12 having a longitudinal axis 14. A number of fuel injector sockets 16 each having a longitudinal axis 18 and open at both longitudinal ends intersect main fuel passage 12 at spaced apart locations along the length of the fuel rail member. In the illustrated example the axes 18 do not intersect axis 14, but rather are slightly offset to one side of axis 14. Only one of the sockets 16 appears in the drawings in the interest of conciseness.

Each socket 16 comprises a top 20 and a bottom 22. An O-ring seal 24 is disposed in a groove in bottom 22 for sealing to a manifold when the fuel rail member is operatively disposed on an engine (not shown).

Each socket 16 further comprises an interior wall surface consisting, from bottom 22 to top 20, of: a circular cylindrical surface portion 26 extending from bottom 22; a frusto-conical shaped surface portion 28 extending from surface portion 26; a circular cylindrical surface portion 30 extending from surface portion 28; a frusto-conical shaped surface portion 32 extending from surface portion 30; an axially upwardly facing shoulder 34 extending from surface portion 32; and a circular cylindrical surface portion 36 extending from shoulder 34 to top 20. An external screw thread 38 is fashioned around the exterior of socket 16 below top 20. Each socket intersects main fuel passage 12, and each such intersection is circumscribed by an opening 40.

Each socket 16 is shaped to receive a fuel injector of the type that is sometimes referred to as a side- or bottom-feed fuel injector. Such a fuel injector 42 is shown mounted in socket 16 in FIG. 5. The fuel injector comprises a flange 44 that is disposed against shoulder 34 to limit the depth to which the fuel injector can be inserted into the socket via the open top of the socket. The fuel injector further comprises two elastomeric O-ring seals 46, 48 seated in respective circular grooves extending around the outside of the fuel injector. O-ring 46 seals against the upper terminus of surface portion 30, and O-ring 48, against the upper terminus of surface portion 26. A cap 49 is threaded onto thread 38 to engage flange 44 and capture the fuel injector in the socket. Between O-rings 46, 48 within socket 16, the fuel injector has inlet ports 50 via which fuel enters the interior of the fuel injector after having been delivered from passage 12 and through opening 40 to the axially ensealed socket space lying between the two O-rings 46, 48. The fuel injector has a nozzle 52 that is posed to inject fuel from the open bottom end of the socket in the operative fuel rail when the fuel injector's solenoid is electrically energized by electric energizing current flowing via terminals 54, 56 at the upper end of the fuel injector.

From the foregoing description, it can be appreciated that the lower O-ring seal 48 will pass axially across opening 40 during insertion and removal of fuel injector 42 into and from socket 16. If opening 40 were to have a sharp edge at its intersection with wall surface portion 30, contact between O-ring 48 and that edge during insertion or removal of the fuel injector could damage the O-ring. While careful insertion and removal might avoid such contact due to the illustrated geometry, reliance on the perpetual exercise of such care would ignore the realities of mass production assembly and service.

Figure 5:
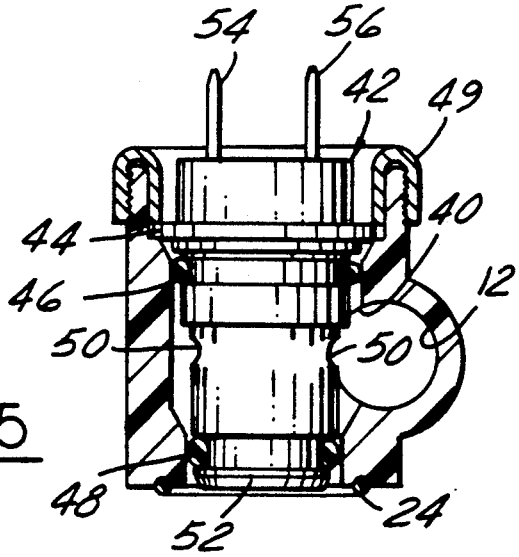
FIG. 5 is a view in the same direction as that of FIG. 2, but showing a fuel injector disposed in the socket.

Accordingly pursuant to the invention, the socket is further provided with two bumpers 58, 60, on interior wall surface portion 30. one to either circumferential side of opening 40 about axis 18. Each bumper is straight and axially co-extensive with opening 40, preferably extending axially somewhat beyond the opening in both directions toward top 20 and bottom 22. Each protrudes radially inwardly a distance that is effective to prevent O-ring 48 from contacting the edge of opening 40 during injector insertion and removal, but that does not in any way interfere with the ultimate proper seating of the injector in the socket as illustrated by FIG. 5. Each bumper has opposite axial ends. The upper axial ends 62 of the bumpers are substantially spherically radiused, and merge smoothly into axially intermediate portions 66 of the bumpers. The lower axial ends 64 of the bumpers merge into surface portion 28. The axially intermediate portions 66 between ends 62, 64 extend axially parallel with surface 30, and as viewed in transverse cross section, they are circularly cylindrically radiused. The lower axial ends 66 continue that radius as they merge with surface 64.

The bumpers present smooth rounded surfaces to the fuel injector so that in the event that the O-ring comes into contact with the bumpers during the insertion or removal process, such as might happen if the fuel injector were to be tipped during insertion or removal, it will pass along a radiused surface that will not damage it. The bumpers can be advantageously incorporated into the fuel rail member by integrally molding them with the socket; in other words, by designing them into the mold that is used to mold the socket so that they are inherently created during the molding process. The illustrated bumpers can be molded without the necessity of undercuts that would require subsequent operations or make the mold more complicated.

Figure 6:
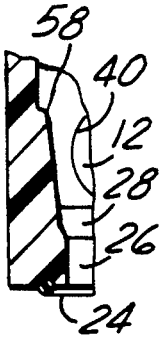
FIG. 6 is a view like that of FIG. 3, but illustrating a modified form.

FIG. 6 illustrates a modified form wherein the bumper is slightly tipped so that its axially intermediate portion 66, while still presenting a radiused surface toward the fuel injector, slopes radially inwardly in the downward direction.

Figure 7:
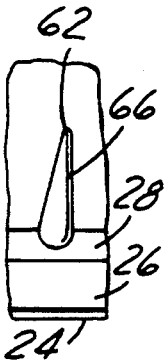
FIG. 7 is a fragmentary view in the same direction as that of FIG. 2, but representative of modified forms of the embodiments of FIGS. 3 and 6.

FIG. 7 illustrates a further modification wherein the bumper has a tapered shape that makes its axially intermediate portion progressively larger in circumferential extent from top to bottom. This taper may be imparted to both embodiments of FIGS. 3 and 6.

These slope and taper features may be helpful respectively in guiding a fuel injector during its insertion into the socket and in attenuating possible fuel flow restriction to the more distant inlet port 50 due to the inclusion of the bumpers.

Figure 1:
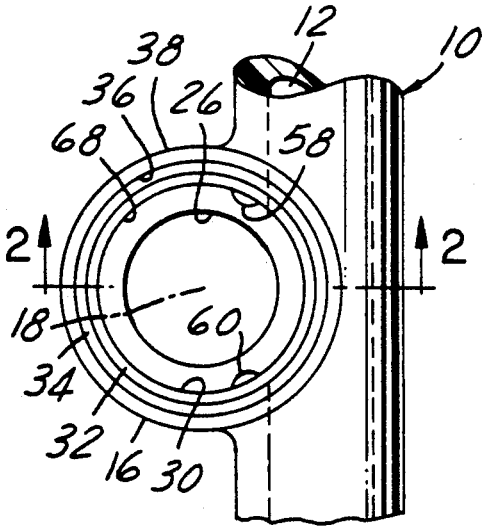
FIG. 1 is a top plan view of a portion of a representative fuel rail including a fuel injector socket.
Figure 4:
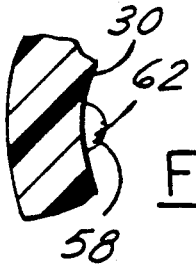
FIG. 4 is an enlarged fragmentary view in the direction of arrow 4 in FIG. 3.

If desired, a third bumper could be provided at the location designated 68 in FIG. 1. The synergy of three bumpers would have a tendency to aid in guiding the injector during insertion and removal.

In any given implementation of the invention, the exact sizes, shapes, radii, etc. for a particular bumper will depend on the size, shape, and dimensions of the particular fuel injector and socket involved. It should also be understood that the process of making a socket by a process such as injection molding of plastic typically requires a slight amount of draft to allow removal of cores from the molded part, and therefore certain surface portions of the socket wall may be only substantially parallel to the injector's central axis, rather than perfectly parallel. Likewise, it should be understood that the illustrated fuel rail is merely representative of one use of the invention. The invention can also be incorporated into a socket that is formed in an engine manifold or a throttle body.

While a presently preferred embodiment of the invention has been illustrated and described, it should be appreciated that principles are applicable to other embodiments.

WHAT IS CLAIMED IS:

1. A fuel injector mounting comprising a socket having an interior wall surface extending inwardly from an open end via which an electromechanical-actuated fuel injector is inserted into the socket, a fuel passage transversely intersecting said interior wall surface so as to provide an opening between said fuel passage and said socket, said interior wall surface having a sealing surface portion disposed interiorly of said socket beyond said opening relative to said open end, said sealing surface adapted to seal in fluid-tight manner with an annular elastomeric seal disposed around and carried by such a fuel injector after such a fuel injector has been inserted into said socket whereby said seal passes across said opening during such insertion, characterized by two bumpers disposed on said interior wall surface, one to either side of said opening circumferentially about said socket, said bumpers protruding radially inwardly from said interior wall surface and presenting rounded surfaces to such a fuel injector so as to be effective to prevent such a seal from contacting said opening during insertion of such a fuel injector into said socket.

2. A fuel injector mounting as set forth in claim 1 characterized further in that said bumpers extend axially of said socket at least coextensive with said opening.

3. A fuel injector mounting as set forth in claim 2 characterized further in that said bumpers have axial ends toward said open end that are substantially spherically contoured.

4. A fuel injector mounting as set forth in claim 3 characterized further in that said bumpers have radiused surfaces extending from said spherically contoured ends in the direction away from said open end and in that said radiused surfaces run axially substantially parallel to said interior wall surface.

5. A fuel injector mounting as set forth in claim 4 characterized further in that said radiused surfaces are also tapered so as to have progressively increasing circumferential extents in the direction away from said open end.

6. A fuel injector mounting as set forth in claim 3 characterized further in that said bumpers have radiused surfaces extending from said spherically contoured ends in the direction away from said open end and in that said radiused surfaces run axially slightly non-parallel to said interior wall surface so as to taper inwardly in the direction away from said open end.

7. A fuel injector mounting as set forth in claim 6 characterized further in that said radiused surfaces are also tapered so as to have progressively increasing circumferential extents in the direction away from said open end.

8. A fuel injector mounting as set forth in claim 1 characterized further by a third bumper disposed substantially equidistant said first two bumpers and opposite said opening.

9. A fuel injector mounting comprising in combination with an electromechanical-actuated fuel injector a socket having an interior wall surface extending inwardly from an open end via which said fuel injector is inserted into said socket, a fuel passage transversely intersecting said interior wall surface so as to provide an opening between said fuel passage and said socket, said interior wall surface having a sealing surface portion disposed interiorly of said socket beyond said opening relative to said open end, said sealing surface sealing in fluid-tight manner with an annular elastomeric seal disposed around and carried by said fuel injector after said fuel injector has been inserted into said socket whereby said seal passes across said opening during such insertion, characterized by two bumpers disposed on said interior wall surface, one to either side of said opening circumferentially about said socket, said bumpers protruding radially inwardly from said interior wall surface and presenting rounded surfaces to said fuel injector so as to be effective to prevent such said seal from contacting said opening during insertion of said fuel injector into said socket.

10. A fuel injector mounting as set forth in claim 9 characterized further in that said bumpers extend axially of said socket at least coextensive with said opening.

11. A fuel injector mounting as set forth in claim 10 characterized further in that said bumpers have axial ends toward said open end that are substantially spherically contoured.

12. A fuel injector mounting as set forth in claim 11 characterized further in that said bumpers have radiused surfaces extending from said spherically contoured ends in the direction away from said open end and in that said radiused surfaces run axially substantially parallel to said interior wall surface.

13. A fuel injector mounting as set forth in claim 12 characterized further in that said radiused surfaces are also tapered so as to have progressively increasing circumferential extents in the direction away from said open end.

14. A fuel injector mounting as set forth in claim 11 characterized further in that said bumpers have radiused surfaces extending from said spherically contoured ends in the direction away from said open end and in that said radiused surfaces run axially slightly non-parallel to said interior wall surface so as to taper inwardly in the direction away from said open end.

15. A fuel injector mounting as set forth in claim 14 characterized further in that said radiused surfaces are also tapered so as to have progressively increasing circumferential extents in the direction away from said open end.

16. A fuel injector mounting as set forth in claim 9 characterized further by a third bumper disposed substantially equidistant said first two bumpers and opposite said opening.

* * * * *